US009922584B2

(12) United States Patent
Chae

(10) Patent No.: US 9,922,584 B2
(45) Date of Patent: Mar. 20, 2018

(54) THREE-DIMENSIONAL SMART MESSENGER ENVELOPE

(71) Applicant: Mun Bae Chae, Seoul (KR)

(72) Inventor: Mun Bae Chae, Seoul (KR)

( * ) Notice: Subject to any disclaimer, the term of this patent is extended or adjusted under 35 U.S.C. 154(b) by 0 days.

(21) Appl. No.: 15/102,072

(22) PCT Filed: Nov. 26, 2014

(86) PCT No.: PCT/KR2014/011414
§ 371 (c)(1),
(2) Date: Jun. 6, 2016

(87) PCT Pub. No.: WO2015/083977
PCT Pub. Date: Jun. 11, 2015

(65) Prior Publication Data

US 2016/0307481 A1 Oct. 20, 2016

(30) Foreign Application Priority Data

Dec. 4, 2013 (KR) ..... 10-2013-0150045

(51) Int. Cl.
*B65D 27/00* (2006.01)
*G09F 23/10* (2006.01)
(Continued)

(52) U.S. Cl.
CPC ..... *G09F 23/10* (2013.01); *B65D 27/12* (2013.01); *B65D 2203/00* (2013.01); *G09F 2023/0025* (2013.01)

(58) Field of Classification Search
CPC ..... G09F 23/10; B65D 27/12
(Continued)

(56) References Cited

U.S. PATENT DOCUMENTS 780,883 A * 1/1905 Hinchman ..... B65D 27/30 206/459.5
1,076,357 A * 10/1913 Euwer ..... B42D 15/08 229/92.7
(Continued)

FOREIGN PATENT DOCUMENTS

JP 2003-104387 A 4/2003
KR 10-2005-0100324 A 10/2005
(Continued)

*Primary Examiner* — Jes F Pascua
(74) *Attorney, Agent, or Firm* — Novick, Kim & Lee, PLLC; Jae Youn Kim

(57) ABSTRACT

The present invention relates to a three-dimensional smart messenger envelope comprising: a main body having contents accommodated therein, and a cover integrally formed with the main body to cover the opening of the main body, wherein the main body and the cover have an overlap portion therebetween when being sealed with each other, the main body includes an advertisement means on the overlap portion, and the advertisement means has a cutoff line formed therearound and includes an advertisement display part that has both side surfaces formed to be cut away or torn off and therefore folded toward the interior of the main body. While the advertisement display part is folded toward the interior of the main body and the cover is sealed, when the cover is open, the advertisement means is located on the inner surface of the cover, and the folded advertisement display part protrudes toward the front of a receiver by repulsive force.

4 Claims, 6 Drawing Sheets

(51) Int. Cl.
*B65D 27/12* (2006.01)
*G09F 23/00* (2006.01)

(58) Field of Classification Search
USPC ..... 229/70, 307, 313, 92.8
See application file for complete search history.

(56) References Cited

U.S. PATENT DOCUMENTS 3,322,329 A * 5/1967 Castaneda ..... B65D 27/34 229/316
3,356,285 A * 12/1967 Greason ..... B65D 27/00 229/70
3,460,743 A * 8/1969 Burnett ..... B65D 27/00 229/68.1
4,470,511 A * 9/1984 Meeker ..... B65D 27/34 229/313
4,607,749 A * 8/1986 Jacob ..... B65D 27/16 229/313
4,729,507 A * 3/1988 Kim ..... B65D 27/38 229/301
5,687,904 A * 11/1997 Potter ..... B65D 27/06 229/303
6,196,447 B1 * 3/2001 Purcell ..... B65D 27/00 229/70
6,237,844 B1 * 5/2001 Purcell ..... B65D 27/00 206/804
6,493,970 B1 * 12/2002 McCarthy ..... G09F 1/04 229/70
9,021,726 B2 * 5/2015 Glass ..... B42D 15/08 229/92.8

FOREIGN PATENT DOCUMENTS

WO 95-03979 A1 2/1995
WO 98-08744 A1 3/1998

* cited by examiner

THREE-DIMENSIONAL SMART MESSENGER ENVELOPE

TECHNICAL FIELD

The present invention relates to an envelope for a letter paper or a gift coupon, more particularly, to a three-dimensional smart messenger envelope capable of effectively providing a recipient with an advertisement or contents of advertisement of a sender when the recipient opens the envelope.

BACKGROUND ART

In general, a letter envelope is used for sending a postal matter and letters, various bills, brochures, and advertising descriptions are put into the letter envelope in use.

Such a letter envelope is fabricated in various forms and provided with a window or an easy opening structure for the convenience of use.

Meanwhile, recently, as the Internet and smart phones become popular, people can simply and easily make communication or transceive information with other people, so the letter envelope is rarely used. Instead, the conventional letter envelopes are mainly used as direct marketing (DM) envelopes which are directly delivered to consumers or customers for the purpose of advertisement.

However, most of recipients who receive the DM envelopes used for the advertisement may discard the DM envelopes without opening the DM envelopes or after checking the advertisement at a glance, unless the recipients interest with the advertisement. For this reason, the desired advertisement effect is not expected from the DM envelopes.

DISCLOSURE

Technical Problem

The present invention has been made to solve the above problems, and an object of the present invention is to provide a three-dimensional smart messenger envelope capable of maximizing the advertisement effect.

Technical Solution

To achieve the above object, the present invention provides a three-dimensional smart messenger envelope including: a main body for storing contents therein; and a cover integrally formed with the main body to cover an opening of the main body, wherein the main body and the cover have an overlap portion therebetween when being sealed with each other, the main body includes an advertisement unit on the overlap portion, the advertisement unit has a cutoff line formed therearound and includes an advertisement display part that has both side surfaces formed to be cut away or torn off such that the advertisement display part is folded toward an interior of the main body, when the cover is open after the advertisement display part is folded toward the interior of the main body and the cover is sealed, the advertisement unit is located on an inner surface of the cover, and the folded advertisement display part protrudes toward a front of a recipient by repulsive force, the advertisement display part includes a sliding contact part making contact with an inner surface of the main body when the advertisement display part is in a folded state, and the advertisement display part is kept in a protruding state from the advertisement unit due to opening force of the cover and sliding contact of the advertisement display part to the inner surface of the main body.

Preferably, the advertisement display part and the advertisement unit may be locally connected and fixed with each other through a tearable bonding part.

Preferably, the advertisement display part may include a gift certificate, a coupon, a meal ticket, and a return present including at least one of a character, a pattern and a figure, and the gift certificate, the coupon, the meal ticket, and the return present may be printed with a bar code, a QR code or an image QR code.

Preferably, the cutoff line may include a pair of first cutoff lines aligned in parallel to each other and a second cutoff line formed at one end of the first cutoff lines and opened toward the first cutoff lines in a shape of a laid 'V', and the pair of first cutoff lines and the second cutoff line may be prepared as a set and spaced apart from each other lengthwise along the overlap portion by a regular interval.

Advantageous Effects

According to the present invention, the visual advertisement effect can be provided to the recipient when the envelope is open and the advertisement effect can be maximized since the recipient can cut off the advertisement unit in use.

BEST MODE

Mode for Invention

Figure 1:
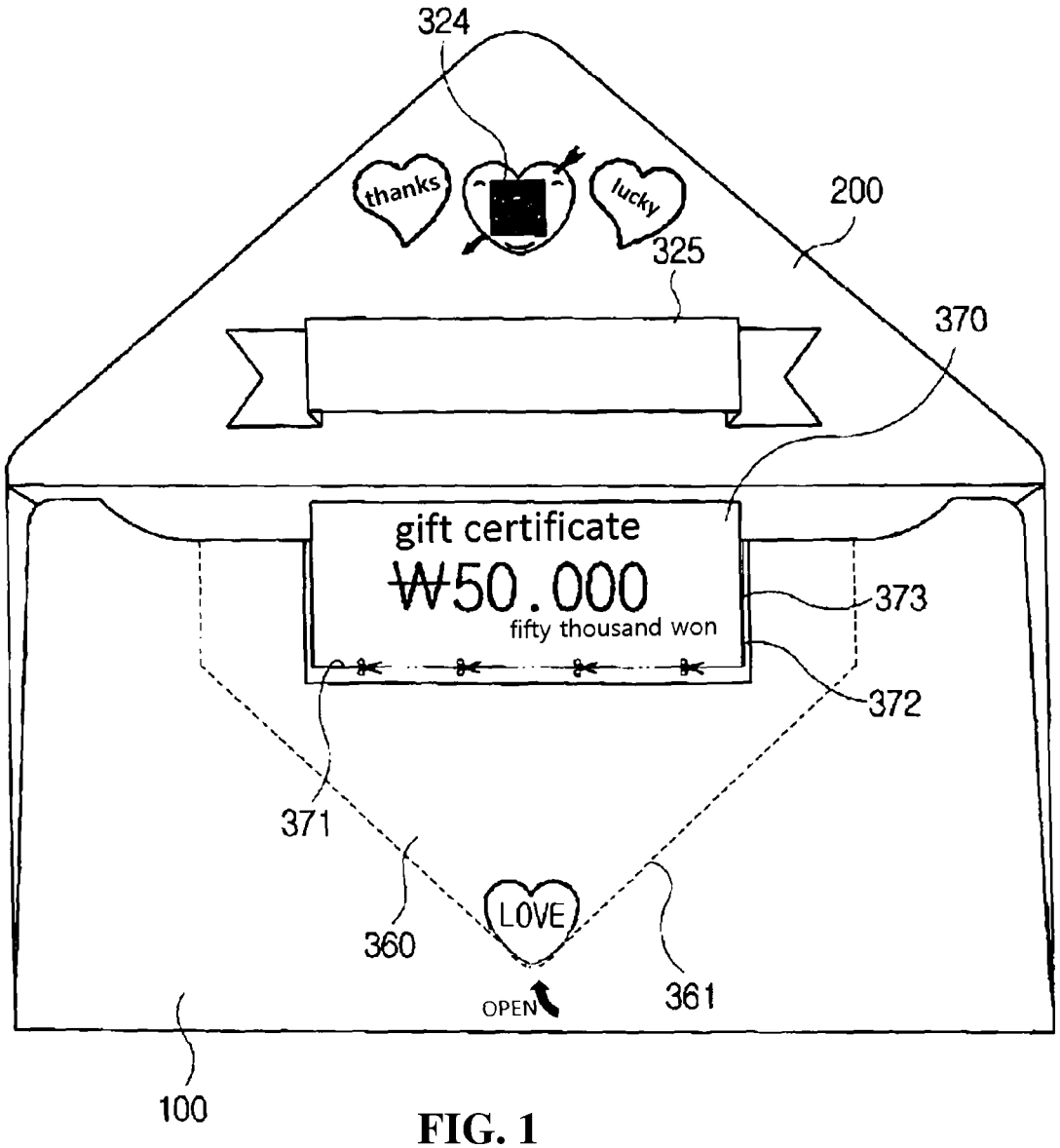
FIG. 1 is a plan view showing a three-dimensional smart messenger envelope according to the present invention before the sealing state.

As shown in FIGS. 1 to 6, a three-dimensional smart messenger envelope according to the present invention includes a main body 100 and a cover 200, in which an advertisement unit 360 is provided in the main body 100 and the advertisement unit 360 moves toward the cover 200 when the envelope is open so that the advertisement unit 360 protrudes toward a front of a recipient.

The main body 100 includes a central portion, a pair of side wing portions positioned to the left and right about the central portion, and a lower wing portion positioned below the central portion, which are sequentially folded in the form of a pocket having an upper portion that is open to receive contents, such as a letter paper. The cover 200 is integrally formed with an upper end of the main body 100 to cover the open upper portion of the main body 100. In this case, an overlap portion is formed between the main body 100 and the cover 200 due to the adhesive sealing, and the overlap portion forms an outer peripheral portion of the advertisement unit 360.

In detail, the advertisement unit 360 is provided at the overlap portion of the body 100. The advertisement unit 360 is formed at an outer peripheral portion thereof with a cutoff line 361. If the cover 200 is open after the envelope is sealed, the overlap part bonded with the cover 200 may move toward the cover 200, so that the cutoff line 361 is torn off and the advertisement unit 360 moves toward the cover 200.

The advertisement unit 360 includes a foldable advertisement display part 370. The advertisement display part 370 may include a gift certificate for promotion of enterprises. In addition, an information input blank, such as a blank for inputting a membership ID of an enterprise, may be provided in the gift certificate. In addition, the advertisement display part 370 of the advertisement unit 360 may include a meal ticket usable in an event hall, such as a wedding hall, or a coupon usable in an enterprise. The advertisement unit 360 including the gift certificate (or coupon) may be utilized as follows.

For example, a recipient tears off the advertisement display part 370, that is, the gift certificate and writes an ID into the information input blank. After that, the recipient can use the gift certificate as cash at the enterprise, which publishes the gift certificate, corresponding to the amount of cashes denoted in the gift certificate. Therefore, the recipient who receives the gift certificate may try to visit the enterprise, which publishes the gift certificate, rather than other enterprises, and the enterprise, which publishes the gift certificate, can effectively manage members based on the member IDs. The above example of the advertisement unit is illustrative purpose only, and the advertisement unit can be variously utilized.

In addition, the advertisement display part 370 of the advertisement unit 360 may be formed with a QR code 321. The QR code 321 is recorded with a variety of information, such as information about URL, photos and dynamic pictures, map information and name card information. Thus, a user can obtain information about the enterprise by scanning the QR code 321. The QR code 321 of the advertisement display part 370 may be replaced with a bar code or an image QR code (QR code printed on an image of corresponding goods).

As described above, three-dimensional smart messenger envelope according to the present invention can provide the recipient with the visual advertisement effect when the user opens the envelope and can maximize the advertisement effect by allowing the recipient to utilize the advertisement unit in the consumption activity by tearing off the advertisement unit.

Figure 2:
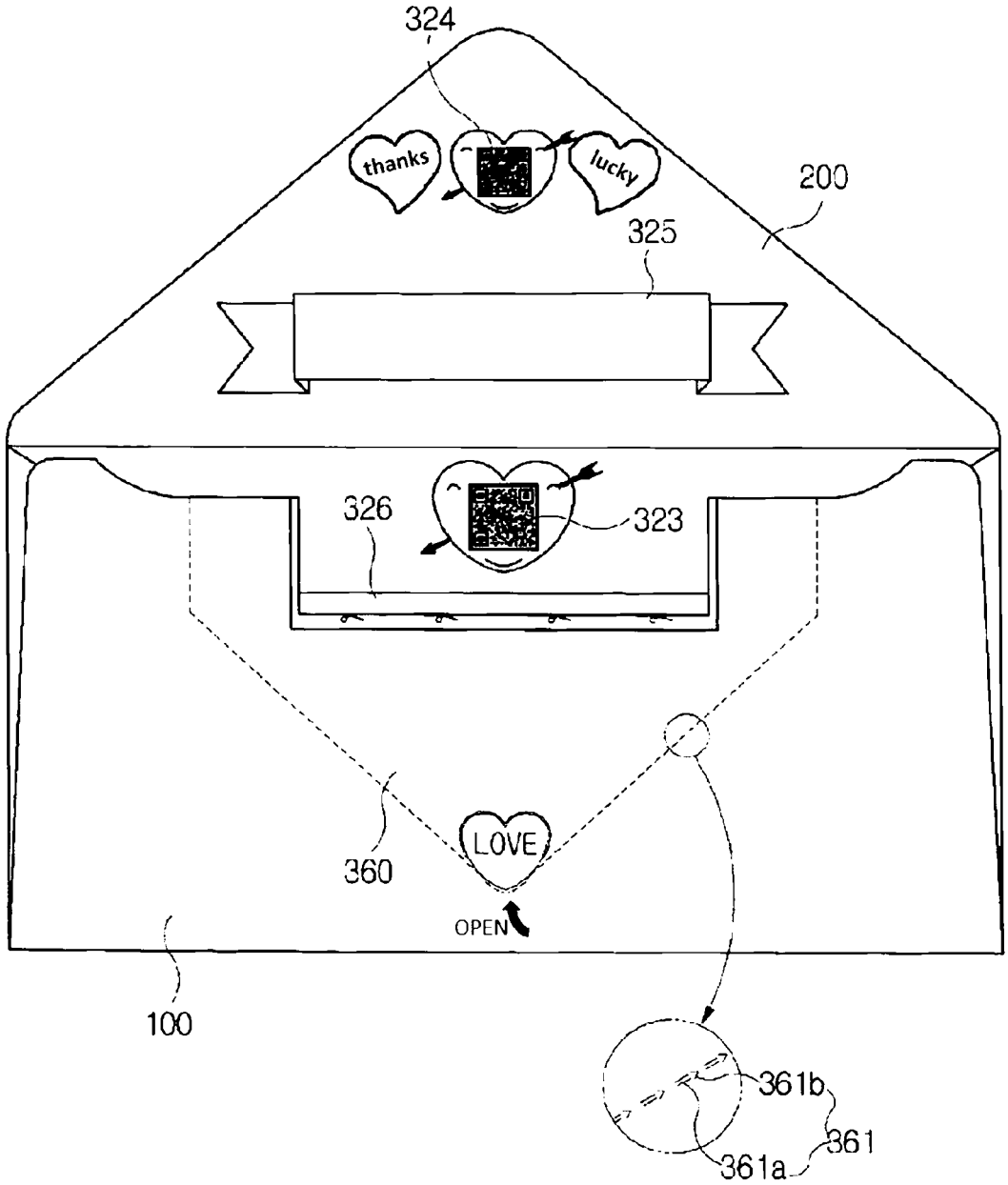
FIG. 2 is a plan view showing a three-dimensional smart messenger envelope according to the present invention when an advertisement display part is folded.

Preferably, referring to FIG. 2, the cutoff line 361 includes a pair of first cutoff lines 361*a* aligned in parallel to each other and a second cutoff line 361*b* formed at one end of the first cutoff lines 361*a* and opened toward the first cutoff lines 361*a* in the shape of a laid 'V'. In addition, the pair of first cutoff lines 361*a* and the second cutoff line 361*b* may be prepared as a set and a series of sets are arranged in the length direction while being spaced apart from each other by a regular interval. Thus, as a whole, the cutoff line 361 has an arrow shape directed in one direction.

Due to the arrangement of the cutoff line 361, if the cutoff line 361 is torn off in one direction, the envelope can be stably torn off owing to the dual first cutoff lines 361*a* and the cutoff direction may not deviate from the cutoff line 361 owing to the second cutoff line 361*b* having directionality.

More preferably, both sides of the advertisement display part 370 may be incised or tearable such that the advertisement display part 370 can be folded inward of the main body 100. In addition, a lower surface of the advertisement display part 370, which is not torn off, may be provided with a folding line 371 to fold the advertisement display part 370. That is, tear lines 372 (or cutoff lines) are formed at both sides of the advertisement display part 370 and a folding line 371 is formed at the lower surface of the advertisement display part 370 so that the advertisement display part 370 can be folded inward of the main body 100.

Figure 3:
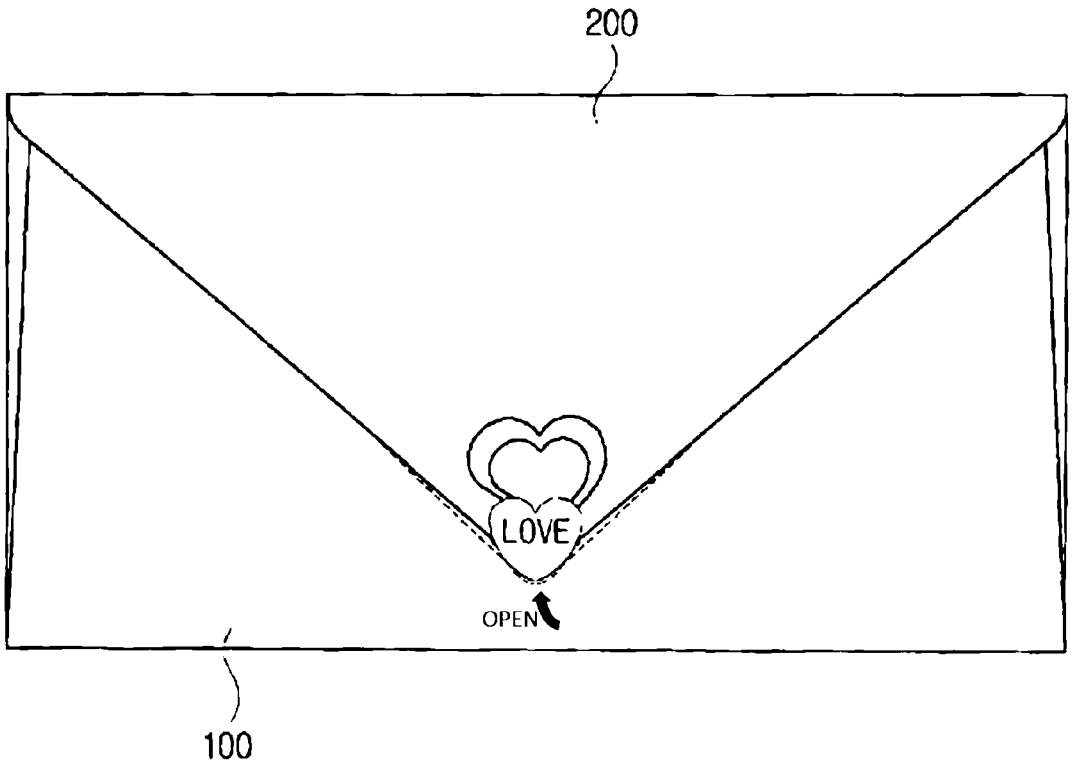
FIG. 3 is a plan view showing a three-dimensional smart messenger envelope according to the present invention in the sealing state.
Figure 4:
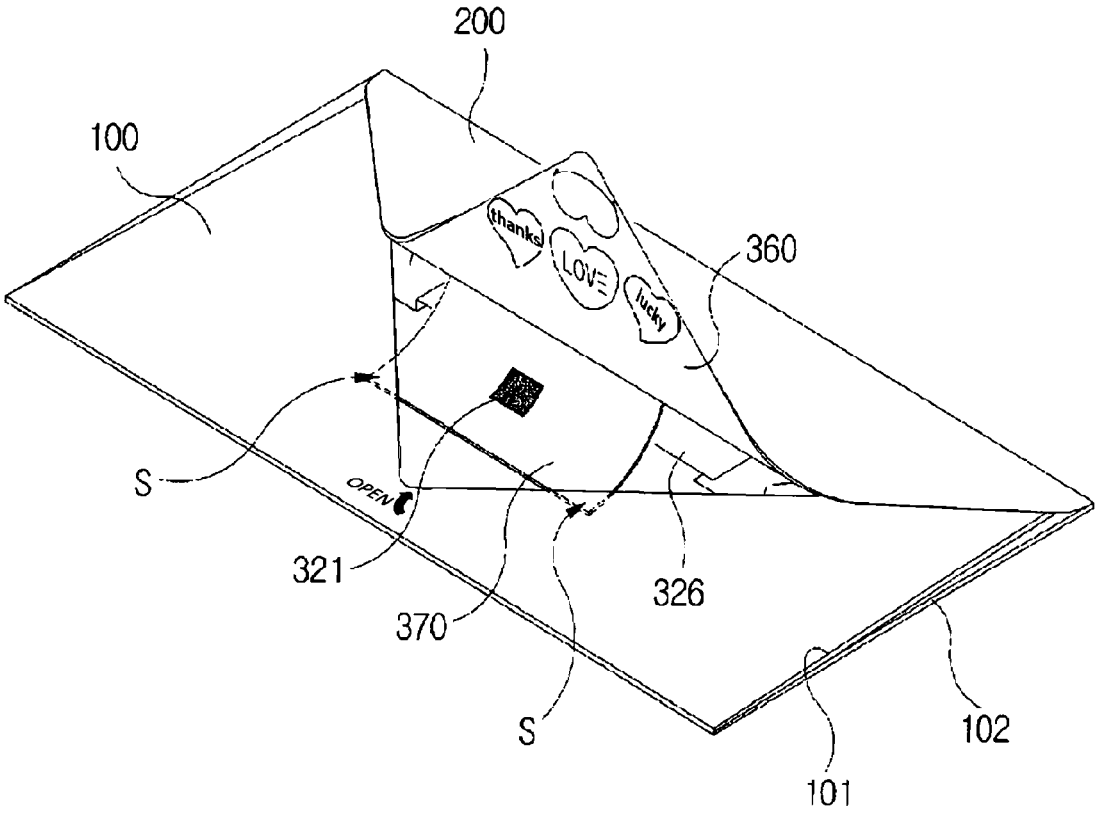
FIG. 4 is a perspective view showing a three-dimensional smart messenger envelope according to the present invention in a state that a cover is being open.
Figure 5:
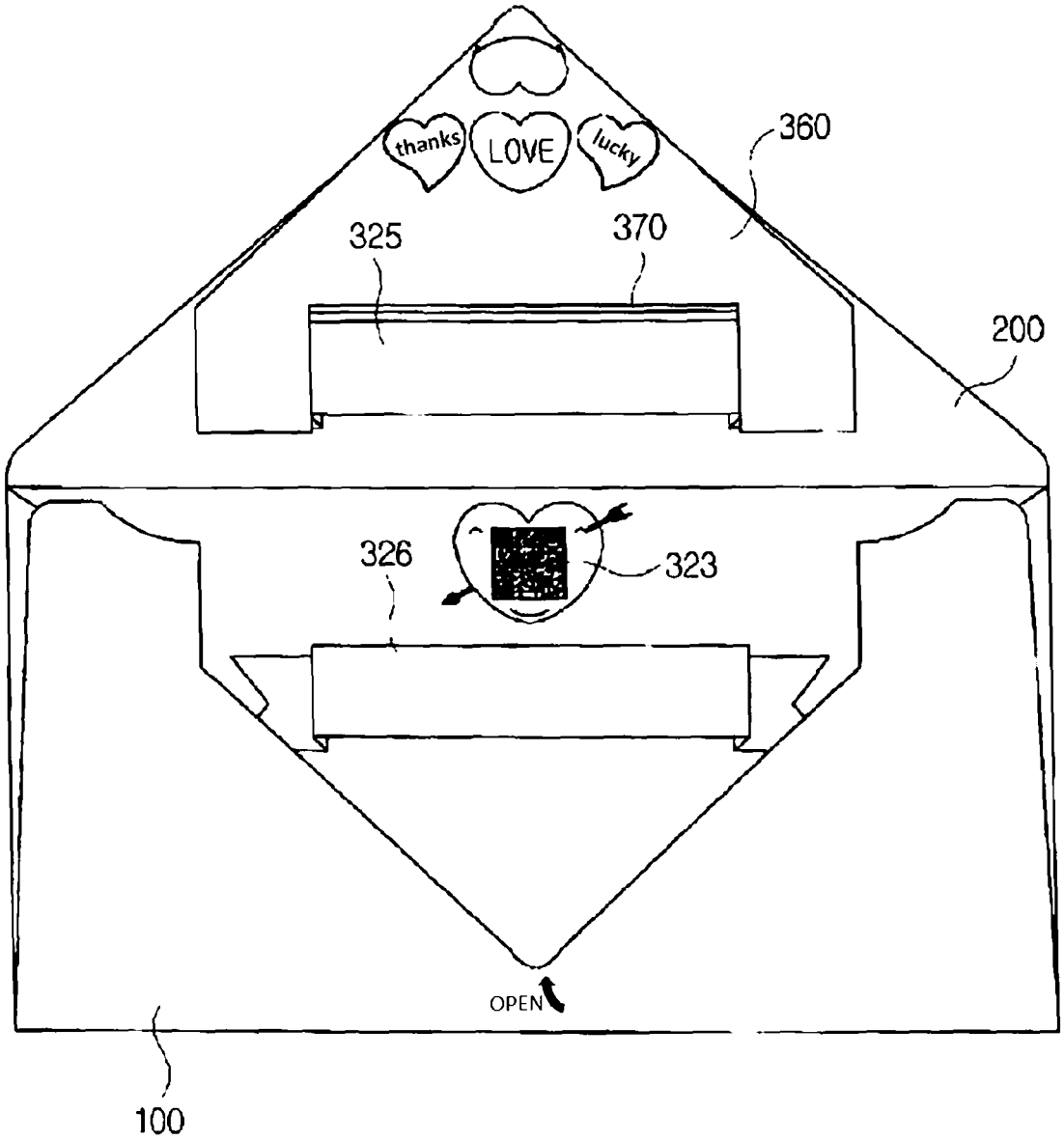
FIG. 5 is a plan view showing a three-dimensional smart messenger envelope according to the present invention in a state that a cover has been open.
Figure 6:
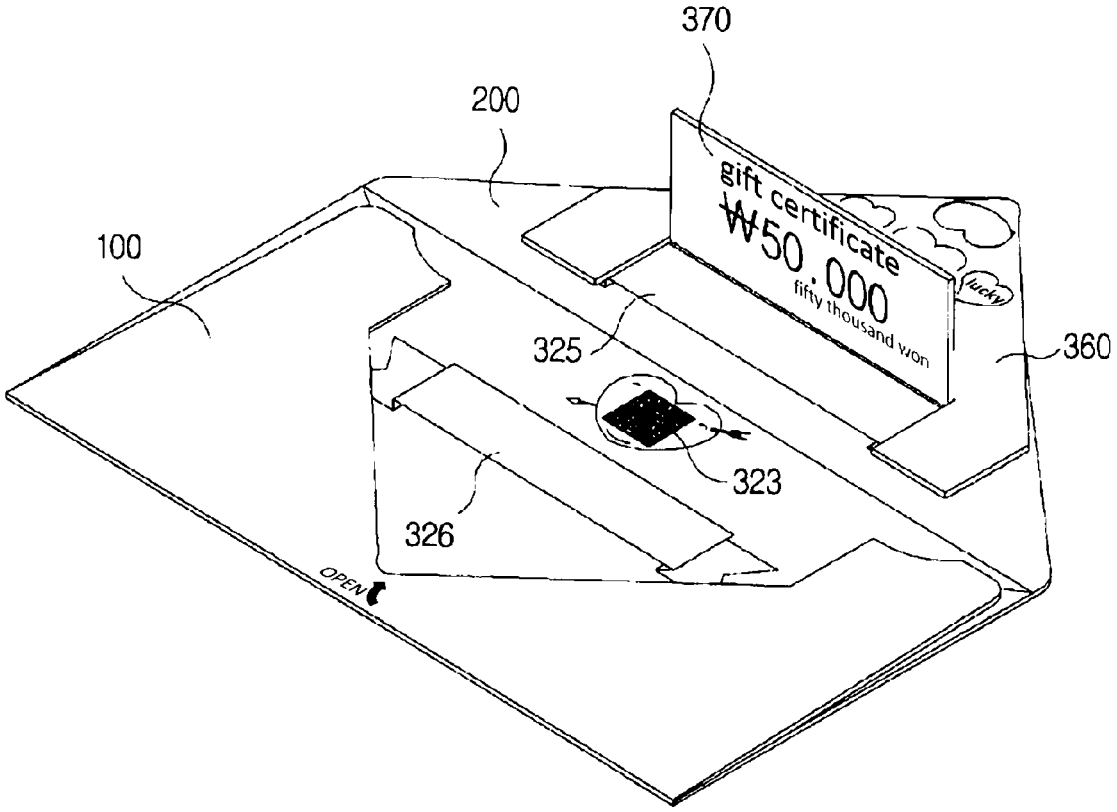
FIG. 6 is a perspective view showing a three-dimensional smart messenger envelope according to the present invention in a state that a cover has been open.

According to the above configuration, the advertisement display part 370 as shown in FIG. 1 is folded inward of the main body 100 as shown in FIG. 2, and the cover 200 is sealed as shown in FIG. 3. Then, if the cover 200 is open as shown in FIG. 4, the advertisement display part 370 is folded from the main body 100 so that the advertisement display part 370 is located in the inner surface of the cover 200 and both lower side ends of the advertisement display part 370, which is folded inward of the main body 100, form a sliding contact part S with respect to the main body 100 as shown in FIG. 4. The sliding contact part S slides while making contact with the main body so that the folded advertisement display part 370 is unfolded and protrudes toward the front of the recipient as shown in FIGS. 5 and 6.

Referring to FIG. 4, when the cover 200 is open by a half, both lower side ends of the advertisement display part 370 are fitted behind the front surface of the main body 100. That is, the advertisement display part 370 is configured to have a size suitable to be located at the inner surface of the main body 100 (the rear of the front surface of the main body facing the recipient) while excessing an interval between the folding line 371 of the advertisement display part 370 and the cutoff line 361 of the advertisement unit 360 in such a manner that the sliding contact part S can be formed when the advertisement display part 370 is folded inward of the main body 100.

According to the configuration of the advertisement display part 370, an end side of the advertisement display part 370, that is, the sliding contact part S is located inside the main body while crossing over the cutoff line 361 of the advertisement unit 360. In this state, the cover 200 is bonded with the main body 100 by glue when the cover 200 is sealed. Then, when the cover 200 is open, the advertisement display part 370 is open while slightly making contact with the cutoff line 361 of the advertisement unit 360 of the main body. Thus, the advertisement display part 370, which is folded inside the main body while being attached to the rear surface of the cover 200, is naturally erected from the advertisement unit 360 and protrudes toward the front of the recipient due to the repulsive force between the sliding contact part S and the main body 100.

In this manner, according to the three-dimensional smart messenger envelope of the present invention, when the recipient opens the envelope, the folded advertisement display part 370 moves while slidably making contact with the inner surface of the main body 100 by the sliding contact part S, so that the advertisement display part 370 can naturally protrudes in a three-dimensional configuration without requiring the erecting or folding of the advertisement display part 370.

Meanwhile, the three-dimensional smart messenger envelope according to the present invention can be manufactured as shown in FIG. 1 by an envelope manufacturing device which is specially designed. In a case that both sides of the advertisement display part 370 are incised, the advertisement display part 370 may be previously folded or rolled in the envelope manufacturing device while the envelope is being manufactured by the envelope manufacturing device. In this case, the advertisement display part 370 may be damaged.

For this reason, the tearable configuration is preferably applied to both sides of the advertisement display part 370. However, if the tearable configuration is applied to both sides of the advertisement display part 370, the both sides of the advertisement display part 370 may not be smooth due to the tear line. Thus, preferably, both sides of the advertisement display part 370 are smoothly incised and the advertisement unit 360 and the advertisement display part 370 are locally fixed to each other by a tearable bonding part 373 in order to compensate for the above problem.

Preferably, the bonding part 373 is located downward from an upper end of the front surface of the main body 100 by a predetermined distance. The position of the bonding part 373 may allow the advertisement display part 370 to be readily folded along the folding line 371 when the recipient tries to fold the advertisement display part 370 into the body 100.

Additionally, as shown in FIG. 5, a QR code 323 and an additional advertising phrase 326 may be printed on the front surface of the main body 100 which is exposed to the outside as the advertisement unit 360 is torn off. Further, as shown in FIG. 1, an additional advertising phrase 325 or a QR code 324 may be printed on the front surface of the opened cover 200. The recipient may recognize the advertising phrase or the QR code printed on the front surface of the cover 200 when the advertisement display part 370, which is moved toward the cover 200 as the envelope is open, protrudes forward while slidably making contact with the main body 100.

The invention claimed is:

1. A three-dimensional smart messenger envelope comprising:

a main body for storing contents therein; and a cover integrally formed with the main body to cover an opening of the main body, wherein the main body and the cover have an overlap portion therebetween when being sealed with each other, and the main body includes an advertisement unit on the overlap portion, wherein the advertisement unit has a cutoff line formed therearound and includes a foldable advertisement display part, wherein the foldable advertisement display part includes a cutout or perforation line on both sides thereof and a fold line on a lower surface thereof such that the foldable advertisement display part is folded into the main body, wherein when the cover is opened after the advertisement display part is folded into the main body and the cover is sealed, the advertisement unit including the foldable advertisement display part is configured to be located on an inner surface of the cover, and the folded advertisement display part is opened while slightly making a contact with the cutoff line of the advertisement unit so as to protrude toward a front of a recipient by repulsive force, and wherein the advertisement display part includes a sliding contact part making contact with an inner surface of the main body when the advertisement display part is in a folded state, and the advertisement display part is kept in a protruding state from the advertisement unit due to opening force of the cover and sliding contact of the advertisement display part to the inner surface of the main body.

2. The three-dimensional smart messenger envelope of claim 1, wherein the advertisement display part and the advertisement unit are locally connected and fixed with each other through a tearable bonding part.

3. The three-dimensional smart messenger envelope of claim 1, wherein the advertisement display part includes a gift certificate, a coupon, a meal ticket, and a return present including at least one of a character, a pattern and a figure, and the gift certificate, the coupon, the meal ticket, and the return present are printed with a bar code, a QR code or an image QR code.

4. The three-dimensional smart messenger envelope of claim 1, wherein the cutoff line includes a pair of first cutoff lines aligned in parallel to each other and a second cutoff line formed at one end of the first cutoff lines and opened toward the first cutoff lines in a shape of a laid 'V', and wherein the pair of first cutoff lines and the second cutoff line are prepared as a set and spaced apart from each other lengthwise along the overlap portion by a regular interval.

* * * * *